US005323708A

United States Patent [19]

Sigler

[11] Patent Number: 5,323,708

[45] Date of Patent: Jun. 28, 1994

[54] CLIP-LOCK SABOT CAP

[75] Inventor: John W. Sigler, La Mirada, Calif.

[73] Assignee: Aerojet-General Corporation, Rancho Cordova, Calif.

[21] Appl. No.: 38,872

[22] Filed: Mar. 29, 1993

[51] Int. Cl.[5] ..... F42B 14/06

[52] U.S. Cl. ..... 102/520; 102/293; 102/521

[58] Field of Search ..... 102/293, 517-523

[56] References Cited

U.S. PATENT DOCUMENTS

| | | | |
|---|---|---|---|
| 3,771,458 | 11/1973 | Schweimler et al. | 102/523 |
| 4,142,467 | 3/1979 | Stahlmann et al. | 102/523 |
| 4,476,785 | 10/1984 | Hoffman et al. | 102/522 |
| 4,517,899 | 5/1985 | Haberli | 102/521 |
| 4,714,024 | 12/1987 | Bocker et al. | 102/521 |
| 4,750,425 | 6/1988 | Sigg et al. | 102/520 |
| 4,757,766 | 7/1988 | Ruffle et al. | 102/521 |
| 4,833,995 | 5/1989 | Gotz et al. | 102/521 |

FOREIGN PATENT DOCUMENTS

| | | | |
|---|---|---|---|
| 133675 | 11/1951 | Sweden | 102/522 |

*Primary Examiner*—Harold J. Tudor

*Attorney, Agent, or Firm*—Leonard Tachner

[57] ABSTRACT

A clip-lock cap for protecting saboted projectiles or penetrators. This cap is formed of several independent segments held together by mechanical clips, the latter being designed to be released from the segments and thus allow dispersal of the segments only when the combined penetrator and cap is exposed to high axial acceleration. It will be understood that because the cap separation from the projectile is achieved through mechanical means, the cap segments can be designed to be as rugged as required to meet rough handling loads and environmental requirements without affecting the reliability or repeatability of the discard process and irrespective of segment material, environmental conditions or projectile spin rate.

11 Claims, 4 Drawing Sheets

CLIP-LOCK SABOT CAP

BACKGROUND OF THE INVENTION

1. Field of the Invention

The present invention relates generally to discarding sabot projectiles and more specifically to a clip-lock protective cap for saboted projectiles, which cap meets environmental and rough handling requirements and is still capable of reliable discard at muzzle exit.

2. Prior Art

The existing protective caps for a saboted projectile utilize a one piece approach with special seams designed to fail under high spin loads. A constant design problem arises trying to make the seams strong enough to withstand handling loads and yet weak enough to easily discard. Because such existing cap designs rely upon failure of the material for separation, discard is not a very repeatable or reliable event. Rough handling and drop tests require that the cap be able to withstand significant abuse. The ability of a cap to survive rough handling and still release during launch provides for design criteria, which in many cases are mutually exclusive. This problem is further exacerbated by the recent trend to reduce the spin rate of certain projectiles.

A patent search has failed to provide any disclosure in the prior art which satisfies the two seemingly contradictory requirements of a cap capable of withstanding rough handling while simultaneously providing repeatable and reliable separation for discard. By way of example, the following U.S. Patents are deemed to be relevant to varying degrees.

U.S. Pat. No. 3,771,458 to Schweimler et al is directed to a sabot projectile that has its core covered by a cap of plastic. The subcaliber core 2 has a nylon plastic cap 1 thereon and a sabot 3 with guide ring 4 and sabot to core coupling spring 5. After the projectile is fired and leaves the gun barrel, centrifugal force expands the coupling spring, disengaging the sabot from the core and cap 1 is destroyed by the centrifugal force.

U.S. Pat. No. 4,750,425 to Sigg et al is directed to a sabot projectile with a plastic hood. The projectile 10 with core 11, sabot tail 15, and sabot jacket 18 has fastened to the jacket a protective hood 21 of plastic anchored by means of a bead 22 in groove 23 of the jacket 18. Upon firing the projectile, the jacket 18 falls apart by failing at the thin webs 19.

U.S. Pat. No. 4,714,024 to Bocker et al is directed to a nose hood for a subcaliber projectile that is fired with the aid of a sabot. The projectile 1 has a nose 10 with a hood 14 of synthetic material glued in place. The hood has a plurality of longitudinal recesses 13 and a frontal air flow receiving surface 15. When the projectile leaves the gun barrel, pressure oscillations caused by the nose hood breaks up the sabot while the hood is being disintegrated.

U.S. Pat. No. 4,142,467 to Stahlmann et al is directed to a subcaliber projectile with a sabot and a hood. The projectile 3 has an aluminum alloy sabot 1 and polyethylene hood 2. The sabot is connected to the hood by a strong snap connection 4, a bead on the sabot engaging a groove on the hood. Two gas ducts 10 enable propellant gases to accelerate the hood relative to the projectile while in the barrel of the firearm, enabling separation when in the barrel.

U.S. Pat. No. 4,757,766 to Ruffle et al is directed to an armor penetrating ammunition assembly provided with a multi-segment aluminum protective cap. The projectile 10 with sabot 18 has a protective cap 26 with stiffening ribs, torque resisting tabs, and rolled stiffening portions. Each segment of the cap 28, 28' is attached to a corresponding segment of the sabot 19, 19'. When fired from a cannon, sabot 18 separates and the cap segments separate with the sabot segments.

SUMMARY OF THE INVENTION

The clip-lock cap of the present invention comprises a nose cap formed of several independent segments held together by a mechanical clip. These clips are designed to release the segments only when exposed to high axial acceleration. Because no material failure is required for the clip-lock cap of the present invention to separate, nose cap discard becomes solely a function of acceleration and clip design. Furthermore, because cap separation is achieved through mechanical means, cap segments can be designed as rugged as required to meet rough handling loads. This makes the clip-lock cap invention herein insensitive to segment material selection, environmental conditions that affect material properties such as temperature or changes in projectile spin rate.

The clip-lock cap is comprised of two or more segments which form a protective covering over the forward portion of a discarding sabot type projectile. In a preferred embodiment of the invention shown herein, the cap is formed by four contiguously positioned segments. Each is secured to its adjoining segments utilizing a U-shaped clip. The clip is installed with an open end facing forward, so upon acceleration the clip slides aft under its own inertial loads, releasing the individual segment for interference-free discard.

The cap of the present invention can be designed similar to a conventional nose cap with an outer profile following the projectile's ogive contour. In this configuration, the clips of the present invention are installed onto the cap segments prior to assembly to the projectile because the cap segments must be pre-assembled prior to attaching the cap to the projectile. This configuration would require that either the clips or cap segments be fabricated from a pliable material if a snap type joint is used for attachment to the sabot. A preferred configuration however, permits access to the clips from outside the cap. This configuration allows clip attachment after the cap is attached to the sabot and thus allows the use of more rigid materials. In either configuration, the individual cap segments provide the structural integrity of the nose cap for rough handling and drop test loading.

OBJECTS OF THE INVENTION

It is therefore a principal object of the present invention to provide a clip-lock sabot cap for saboted projectiles, the cap being configured for satisfying environmental and rough handling requirements and yet still being capable of reliable discard at muzzle exit of the projectile.

It is an additional object of the present invention to provide a clip-lock sabot cap comprising several independent segments held together by mechanical clips, the latter being designed to release the segments only when exposed to high axial acceleration.

It is still an additional object of the present invention to provide a clip-lock sabot cap which is insensitive to segment material selection, environmental conditions that affect material properties or changes in projectile spin rate so that sabot discard is a repeatable and reliable event.

BRIEF DESCRIPTION OF THE DRAWINGS

The aforementioned objects and advantages of the present invention, as well as additional objects and advantages thereof will be more fully understood hereinafter as a result of a detailed description of preferred embodiments when taken in conjunction with the following drawings in which.

DETAILED DESCRIPTION OF A PREFERRED EMBODIMENT

Figure 1:
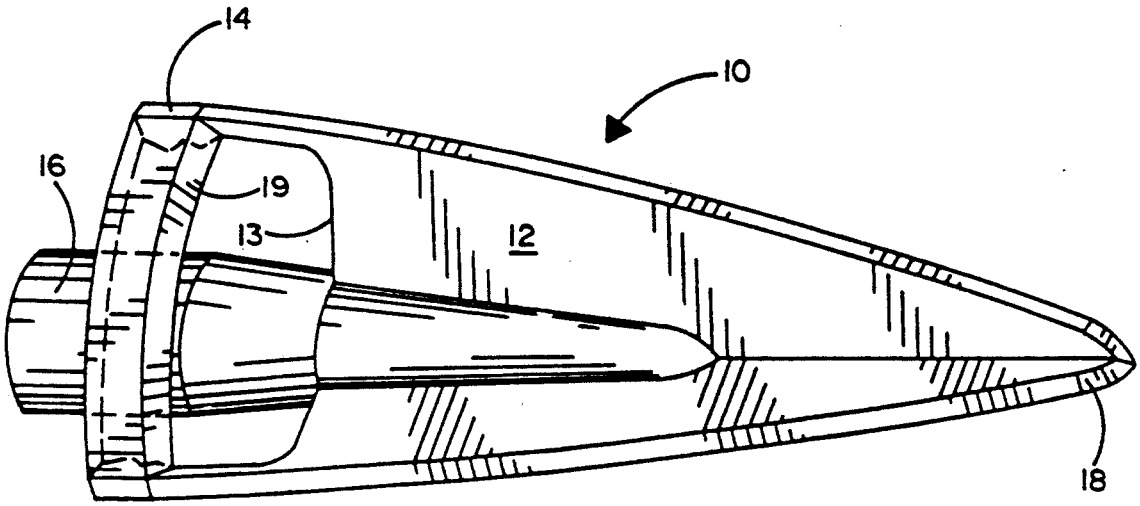
FIG. 1 is an isometric view of a unitary segment of a four piece nose cap in accordance with the present invention.
Figure 2:
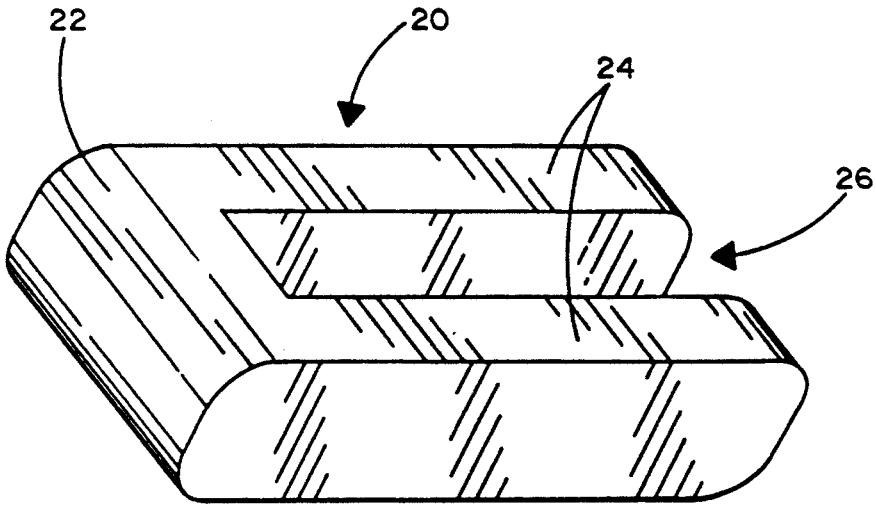
FIG. 2 is an isometric view of a typical clip configuration used in the present invention.

The clip-lock cap of the present invention is comprised of two or more segments which form a protective covering over the forward portion of discarding sabot type projectiles. FIG. 1 illustrates a segment 10 for a four piece cap. Each cap segment is secured to its adjoining segments, utilizing a U-shaped clip 20. The clip 20 is shown in FIG. 2 and is installed with the open end facing forward, so that upon acceleration, the clip slides aft under its own inertial loads, releasing the individual segments for interference free discard. The individual cap segments provide the structural integrity of the nose cap for rough handling and drop test loading. The cross section of the individual cap segments vary according to the level of strength required by the handling loads. Cap segments usually have flat radial surfaces to interface with the adjoining segments for locking the segments together. Various types of seal designs may be incorporated into these mating surfaces to obtain an environmental seal.

As seen in FIG. 1, the segment 10 comprises a web portion 12, the web extending radially outward to a segment interface 18 and radially inward toward a penetrator receptacle 16. The segment interface 18 extends rearwardly or aft to a snap-on joint 14, which is integrally connected to a ring 19. As shown in FIG. 2, each clip 20 comprises a base 22 and a pair of parallel integral legs 24, separated by a space 26. Spacing 26 is selected so that when the clip is press fit onto the aft portion of web 12 of segment 10 at approximately the location labelled reference numeral 13 in FIG. 1, the space 26 can accommodate two adjoining web portions from adjacent segments.

Because the lock clips provide the separation mechanism, the cap segments can be fabricated from the wide variety of materials without affecting nose cap discard. Segment material selection is based primarily upon rough handling requirements and overall projectile weight. The clip-lock design of the present invention allows use of materials ranging from plastics, such as polyethelyne to aluminum or steel for fabrication of the cap segments.

The clip of the present invention is designed to provide the correct amount of closure force to maintain an environmental seal between the segments and to release the segments when exposed to high axial accelerations. The amount of closure force is determined by the stiffness of the clip and the interference fit of the clip over the mating surfaces of the segments. The amount of closure force required is determined by the rough handling requirements the round must meet. The force necessary to release the clip can be determined analytically or easily measured from a prototype model. Once the required force is known, the weight of the clip can be adjusted to achieve this value. The release force is simply the product of the clip's weight and the acceleration of the projectile in the barrel. In most applications, reasonable compatability can be maintained between the segment and the clip materials.

Figure 4:
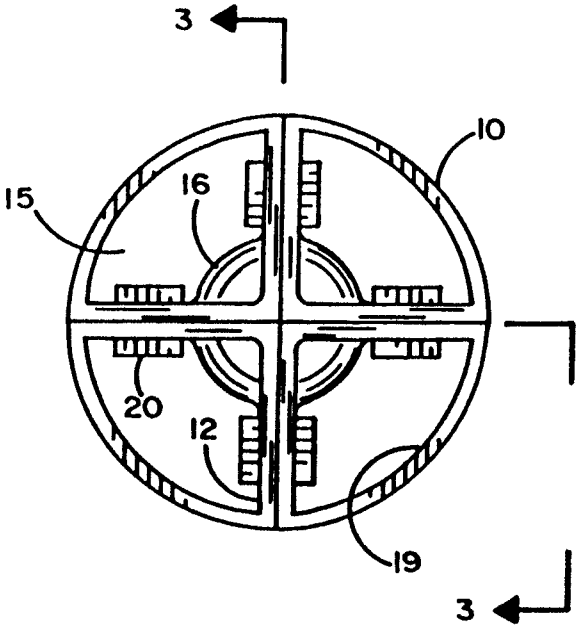
FIG. 4 is an end view of the clip-lock nose cap of FIG. 3.
Figure 3:
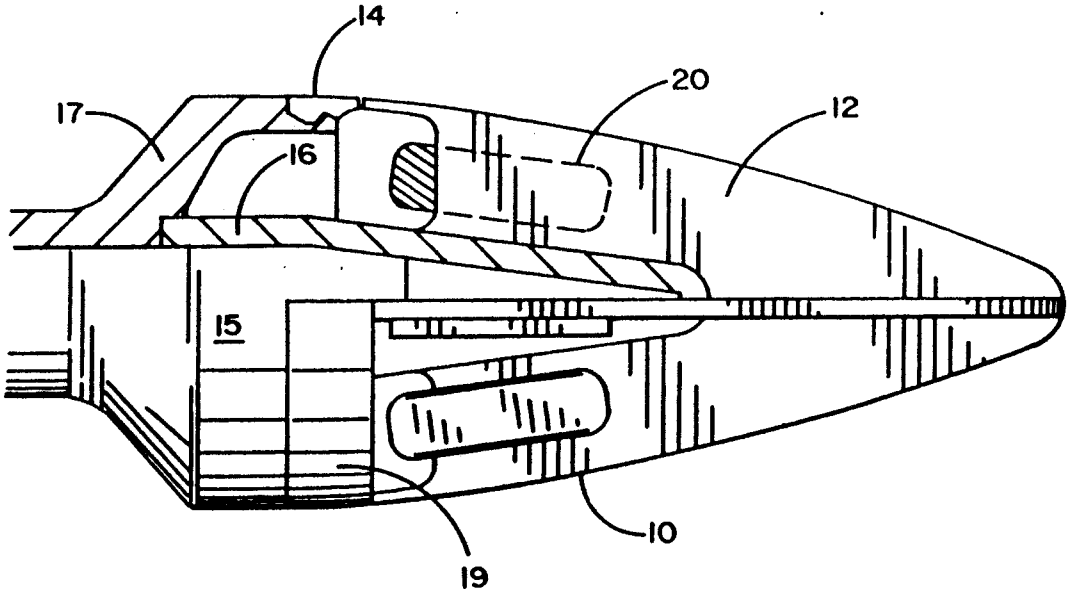
FIG. 3 is a partially cross-sectioned plan view of a first embodiment of a clip-lock nose cap in accordance with the present invention.
Figure 5:
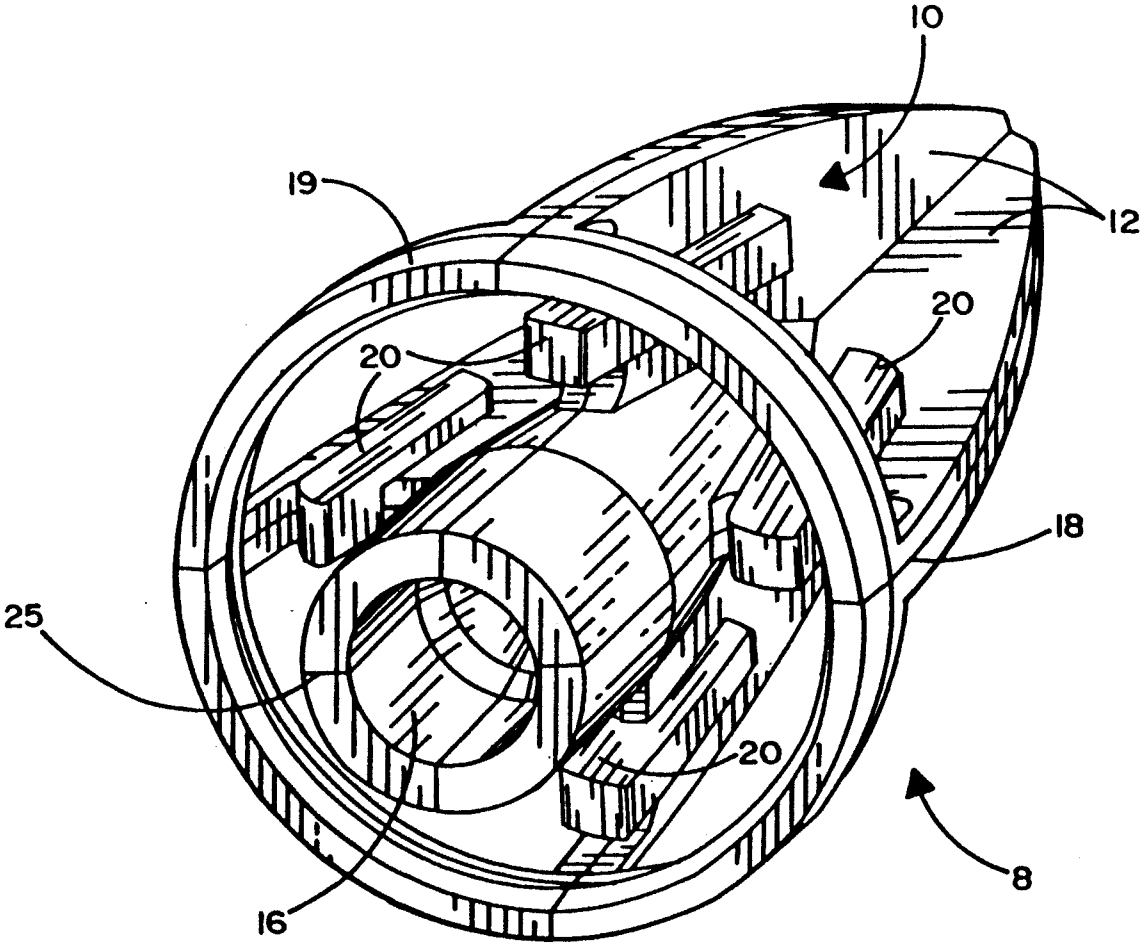
FIG. 5 is an isometrical view of the nose cap of the first embodixent of the present invention shown in its fully assembled configuration ready for installation on a sabot of a projectile.

FIGS. 3, 4 and 5 illustrate a first configuration which allows access to the clips from outside the cap. This configuration allows the option of installing the clips after the cap has been attached to the sabot. This would allow the use of rigid material for the segments, as well as sabot joint designs other than a conventional snap-on type. This configuration also minimizes the volume of cap material for weight reduction. By forming the environmental seal on the surface of the penetrator, less material is required and the task of maintaining the seal is easier. During rough handling or drop testing, the outer portions of the nose cap design of FIGS. 3 through 5 may undergo significant bending and/or cracking without affecting the environmental seal or overall integrity of the nose cap.

The actual interconnection of adjacent segments of the cap of the present invention may be best understood by referring to FIGS. 3, 4 and 5, wherein it is shown that a completely assembled clip-lock cap 8 of the present invention in the embodiment illustrated therein, comprises four segments 10 mated to one another at respective segment interfaces 18 spaced at 90 degree intervals around the circumference of the cap 8. As shown in FIG. 5, each such segment interface may be provided with an environmental seal 25. Four clips 20 are provided and are shown installed, each holding together two adjacent segments. In addition, each ring portion 19 of the respective segments and each portion of penetrator receptacle 16 of the respective segments are shown joined to form a complete ring and receptacle, respectively. As shown in FIG. 3, the receptacle 16 receives a penetrator 15 and the ring 19 mates with a sabot 17 by means of a snap-on joint 14.

Figure 7:
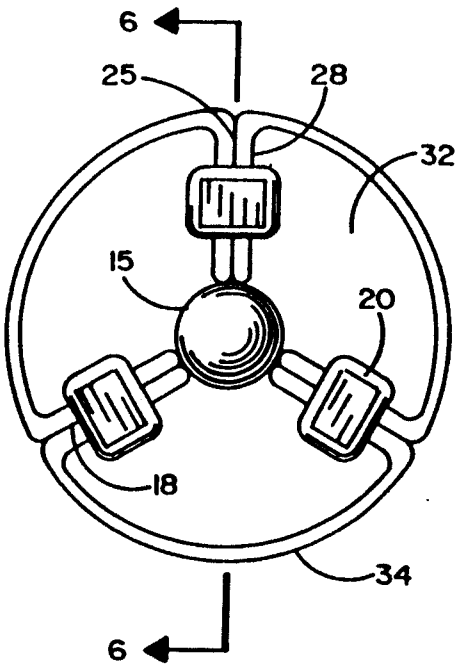
FIG. 7 is a cross-sectional view of a nose cap of FIG. 6.
Figure 6:
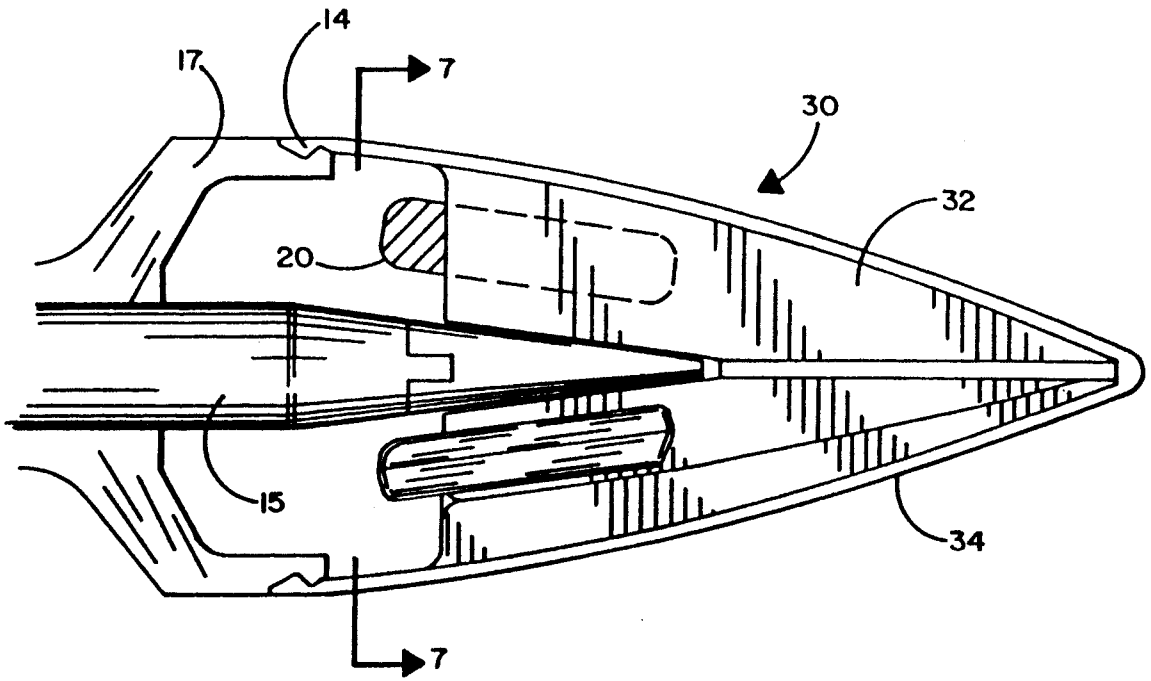
FIG. 6 is a cross-sectional plan view of a clip-lock nose cap in accordance with a second embodiment of the present invention.

The clip-lock cap can also be designed to be similar to a conventional nose cap with an outer profile following the projectile's Ogive contour. An example of this embodiment of the invention of a clip-lock cap is shown in FIG. 6 and 7. In this configuration, the clips are installed onto the cap segments prior to assembly to the projectile. Since the cap segments must be preassembled prior to attaching the cap to the projectile, this configuration requires that either the clips or the cap segments be fabricated from a pliable material if a snap type joint is used for attachment to the sabot.

As shown in FIGS. 6 and 7, this embodiment of the invention, which for purposes of illustration, comprises a three segment configuration, is similar to the embodiment of FIGS. 3, 4 and 5 except that the second embodiment 30 employs an ogive configured segment 28, wherein the web portions 32 enclose the clips 20 so that externally of the cap 30, only the segment interfaces 34 are accessible, thereby making it necessary to attach the clips to the segments and assemble the segments to one another prior to affixing the cap 30 to the penetrator 15.

Thus it will be seen that the present invention comprises a clip-lock cap for protecting saboted projectiles or penetrators. This cap is formed of several independent segments held together by mechanical clips, the latter being designed to be released from the segments and thus allow dispersal of the segments only when the combined penetrator and cap is exposed to high axial acceleration. It will be understood that because the cap separation from the projectile is achieved through mechanical means, the cap segments can be designed to be as rugged as required to meet rough handling loads and environmental requirements without affecting the reliability or repeatability of the discard process and irrespective of segment material, environmental conditions or projectile spin rate.

It will now be apparent to those having skill in the art to which the present invention pertains, that various modifications and additions may be made to the invention. By way of example, the precise shape and dimensions of the respective portions of the clip-lock cap described herein may be readily altered depending upon the shape and dimensions of the projectile and sabot to which the cap is connected. Furthermore, it will be understood that the clip used herein, as well as the segment portions to which the clips are attached, may be readily altered in shape and dimension without deviating from the teachings disclosed herein. Accordingly, all such modifications and additions are deemed to be within the scope of the invention which is to be limited only by the claims appended hereto and their equivalents.

I claim:

1. A projective nose covering cap for sabot projectiles, which cap disperses and discards upon muzzle exit of the projectile; the cap comprising:

a plurality of segments in abutting contiguous relation at respective interface regions;

at least one clip press fit onto at least two of said segments at respective interface regions for securing said segments to one another;

said clip having a base and at least two spaced apart parallel legs extending from said base for securing said respective interface regions therebetween;

said clip being positioned on said segments at an unobstructed aft portion of said interface regions for automatic withdrawal therefrom upon a preselected level of axial acceleration of said cap.

2. The cap recited in claim 1 further comprising:

means for attachment to a projectile having a sabot.

3. The cap recited in claim 2 wherein said attachment means comprises a conically-shaped receptacle and wherein each said segment provides a portion of said receptacle.

4. The cap recited in claim 2 wherein said attachment means comprises a snap-on joint for mating with a projectile at a sabot thereof.

5. The cap recited in claim 2 wherein said attachment means comprises a ring and wherein each said segment provides a portion of said ring.

6. A discarding-type nose cap for protecting muzzle-launched projectiles having a sabot; the cap comprising:

a plurality of separate segments joined together at interface regions to form said cap; and a plurality of clips mechanically joining said segments along an unobstructed aft portion of said interface regions for automatic withdrawal therefrom upon sustaining a preselected axial acceleration; wherein each said clip comprises a base and at least two spaced parallel legs extending from said base for compressing together at least two of said interface regions of respective segments.

7. The cap recited in claim 6 wherein said base of each said clip is oriented toward the aft of said cap and said legs of each said clip are oriented toward the nose of said cap.

8. The cap recited in claim 6 further comprising:

means for attachment to a projectile having a sabot.

9. The cap recited in claim 8 wherein said attachment means comprises a conically-shaped receptacle and wherein each said segment provides a portion of said receptacle.

10. The cap recited in claim 8 wherein said attachment means comprises a snap-on joint for mating with a projectile at a sabot thereof.

11. The cap recited in claim 8 wherein said attachment means comprises a ring and wherein each said segment provides a portion of said ring.

* * * * *